United States Patent [19]

Curry et al.

[11] Patent Number: 4,529,206

[45] Date of Patent: Jul. 16, 1985

[54] GAME APPARATUS HAVING A PLAYING FIELD WITH ADJUSTABLE PATH-FORMING ELEMENTS

[76] Inventors: David B. Curry, 222 SW. Texas, Portland, Oreg. 97219; David L. Withers, 3424 Archer Ct., NW., Salem, Oreg. 97304

[21] Appl. No.: 592,460

[22] Filed: Mar. 22, 1984

[51] Int. Cl.[3] ..... A63F 3/00; A63F 3/02

[52] U.S. Cl. ..... 273/261; 273/280; 273/282; 273/284

[58] Field of Search ..... 273/261, 280, 287, 284, 273/275, 271, 264, 282 B, 282 C

[56] References Cited

U.S. PATENT DOCUMENTS

| | | | |
|---|---|---|---|
| 1,980,637 | 11/1934 | Savory | 273/280 |
| 2,585,268 | 2/1952 | Olsen | 273/258 |
| 3,172,666 | 3/1965 | Ryan | 273/280 X |
| 3,193,293 | 7/1965 | Schaper | 273/275 |
| 3,655,194 | 4/1972 | Pierson | 273/275 X |
| 3,695,615 | 10/1972 | Shoptaugh | 273/275 |
| 3,761,093 | 9/1973 | Migliore | 273/284 X |
| 3,820,791 | 6/1974 | Powers | 273/284 X |
| 4,341,386 | 7/1982 | Kleva | 273/239 |
| 4,440,395 | 4/1984 | Hyland et al. | 273/241 |

FOREIGN PATENT DOCUMENTS

| | | | |
|---|---|---|---|
| 2951790 | 7/1980 | Fed. Rep. of Germany | 273/284 |

*Primary Examiner*—Richard C. Pinkham
*Assistant Examiner*—Scott L. Brown
*Attorney, Agent, or Firm*—Kolisch, Hartwell & Dickinson

[57] ABSTRACT

Game apparatus comprising a playing field and plural path-forming elements rotatably disposed on the playing field. The elements are arranged in elongate intersecting rows, and are rotatable to align path segments provided on the elements. The elements are mounted in cylindrical recesses in the game board and have a raised ridge to assist in rotating the elements. Playing pieces which have a channel fitting over the ridge are also provided.

10 Claims, 8 Drawing Figures

GAME APPARATUS HAVING A PLAYING FIELD WITH ADJUSTABLE PATH-FORMING ELEMENTS

BACKGROUND AND SUMMARY OF THE INVENTION

This invention pertains to a game played on a playing field, such as a board, having adjustable, path-forming elements. More specifically, it pertains to such a game played on a playing field on which are rotatably disposed an array of elements disposed in intersecting rows, with each element having a surface feature which defines a path segment. These segments may be aligned within a row to form a path along which playing pieces may travel.

Although the following discussion is directed specifically to a game having a playing board, other forms of the game may be developed which are also included within this invention.

Many game boards exist which have fixed travel paths along which playing pieces travel during the course of a game. Other games provide playing boards on which tiles containing path segments may be placed in order to create a travel path along which a playing piece may progress. Such tiles once placed on the board become fixed in their orientation with respect to other tiles.

An object of this invention is to provide a game having a playing field on which paths along which a playing piece may travel may be arranged and rearranged during the course of play.

Another object of the present invention is to provide such a playing field having defined rows along which travel paths may be formed.

It is a further object to provide a game board wherein path segments defining a travel path may be misaligned, preventing travel by a playing piece between adjacent path segments.

These and additional objects and advantages are provided in applicant's preferred embodiment which includes a game board having a generally hexagonal shape. An array of elements or disks are rotatably mounted on the board for rotation in the plane of the board. The elements are disposed in a plurality of intersecting rows, the rows being equiangularly offset with respect to each other. Each element has a surface feature which defines a path segment, and the path segments of multiple elements may be aligned in a row to form a path along which a playing piece may travel. Each element is disposed in what may be considered as the intersection of three rows, thereby permitting through proper positioning of the element inclusion of the path segment associated with the element in a path extending along any one of the three rows. In another position of an element, the path segment of the element is not in alignment with any of the three rows.

It can therefore be seen that a game board made as described provides substantial flexibility in the arrangemment and rearrangement of travel paths across the board during play, thus creating a constantly changing board layout according to the whims of the game participants.

These and additional objects and advantages of the present invention will be more clearly understood from a consideration of the drawings and the following detailed description of the preferred embodiment.

DETAILED DESCRIPTION OF THE INVENTION

Figure 1:
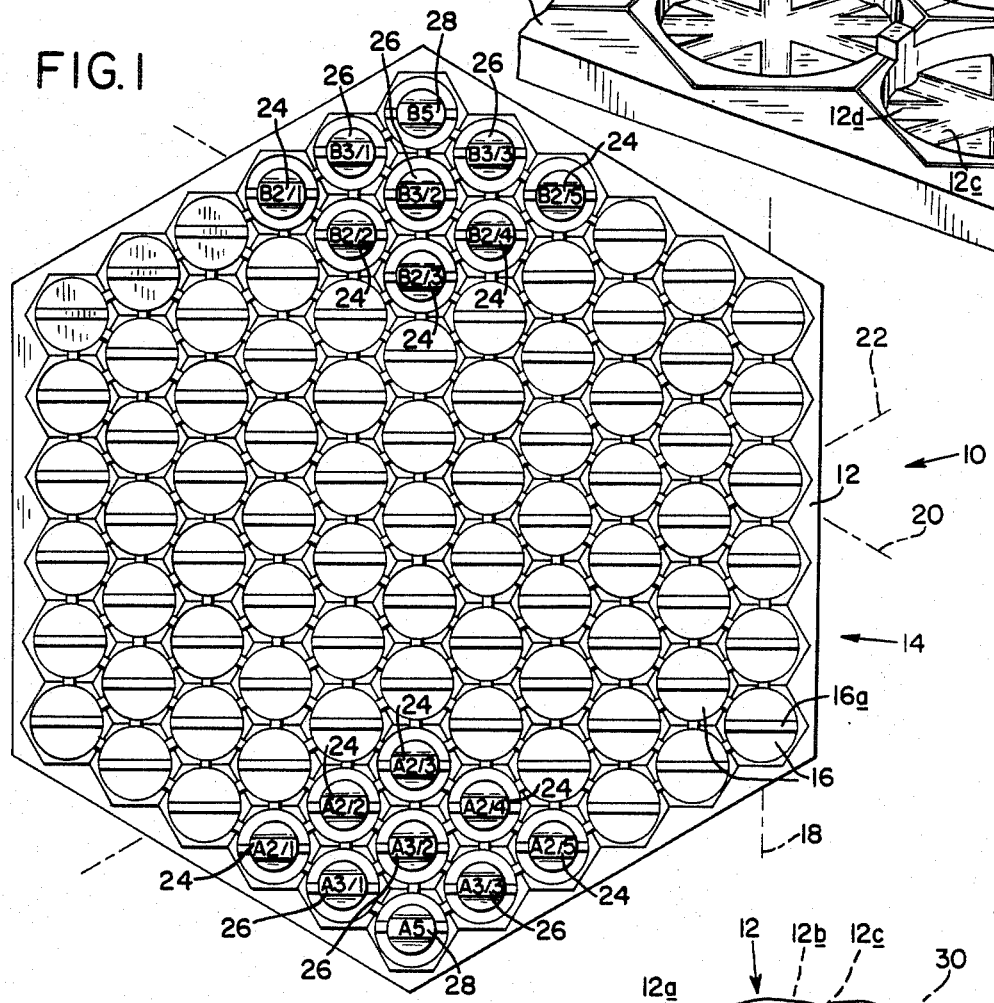
FIG. 1 is a plan view of a game board, with adjustable path-forming elements and playing pieces setup for the start of a game as contemplated by the invention.
Figure 2:
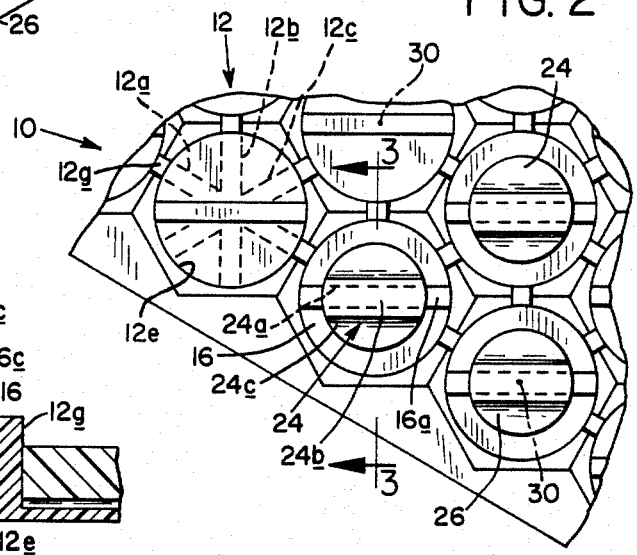
FIG. 2 is an enlarged, fragmentary view of a portion of FIG. 1.

Referring initially to FIG. 1, game apparatus shown generally at 10 includes a game board 12, and an array, shown generally at 14, of path-forming elements or disks, exemplified by element 16. It will be noted that board 12, also referred to as means defining a playing field, has a hexagonal outline, corresponding generally to the outline of the array of elements 16.

Each element 16 has other elements just like it immediately adjacent the element and disposed in a region surrounding the element. These immediately adjacent elements, and the element surrounded by the adjacent elements, are part of three rows of elements extending over the face of the game board. The rows are equiangularly offset, and intersect at the center of the element surrounded by the adjacent elements.

Thus, in FIG. 1, the element marked 16 together with the elements immediately above and below this element form one row extending vertically on the page, along the dot-dashed line indicated at 18. The element marked 16 and the element immediately adjacent and to the upper left of the element form part of another row of elements extending along the dot-dashed line indicated at 20. The element marked 16 and the immediately adjacent element to the lower left of the element so marked form part of another row extending along the dot-dashed line indicated at 22.

Figure 4:
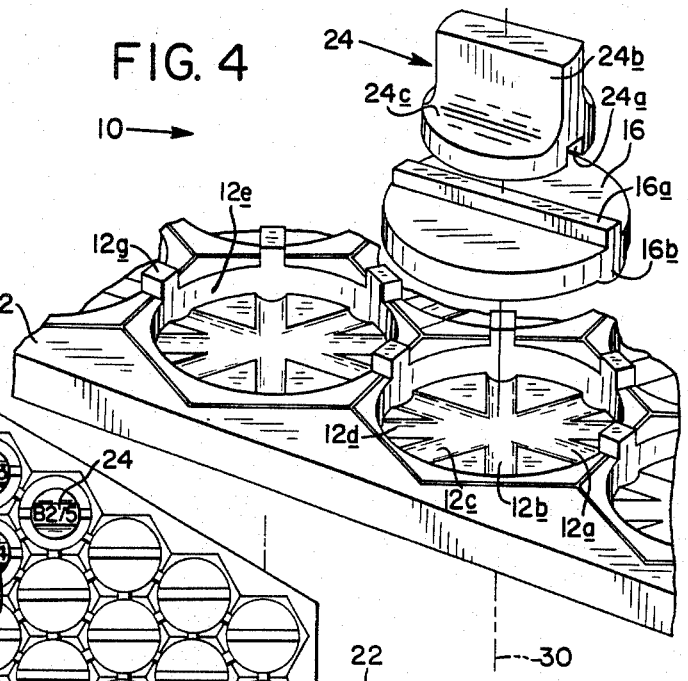
FIG. 4 is an exploded perspective view of a portion of FIG. 2.

Formed on the face of each element or disk 16, as illustrated in FIGS. 1 and 4, is an elongate ridge or shoulder, or rectilinear surface feature, defining a path segment 16*a*. In FIG. 1, all of the disks 16 are oriented with the path segments of the disks extending horizontally. With this orientation, none of the path segments of immediately adjacent disks are aligned. This orientation of the disks may be used at the beginning of the game, to prevent the appearance on the game board of path segments aligned vertically, as is row 18, or diagonally, as are rows 20 and 22.

As perhaps best illustrated in FIG. 4, game board 12 is provided over the face thereof with shallow recesses of circular outline, as exemplified by the recess shown at 12*e*. Each recess rotatably receives a disk 16 with the disk being rotatable in the plane of the board, or about an axis extending perpendicular to the board. Such axis is indicated at 30 in FIG. 4.

Provided in the floor of each recess 12*e* are shallow rounded grooves 12*a*, 12*b*, 12*c*, and 12*d*. A shallow rib 16*b* is formed extending along the base of each disk, the rib being in alignment with shoulder 16*a*. The rib and shallow grooves cooperate to perform a positioning function for a disk. The rib seats within one groove when the shoulder of the disk extends diagonally, as is row 20, another groove when this shoulder extends diagonally, as is row 22, and another groove when the shoulder extends vertically, as is row 18 in FIG. 1. The rib seats within the remaining groove with the disk positioned so that its shoulder 16*a* extends horizontally, as pictured in FIG. 1.

Referring to FIG. 4, shown at 24 is a playing piece. Such includes a circular base 24*c*, an elongate channel 24*a* extending along the underside of the base in the playing piece, and a tab-like handle 24*b* projecting upwardly from base 24*c*. Preferably the handle 24*b* is oriented with such paralleling channel 24*a* in the disk, since in this way the player knows the direction that the channel extends from viewing the direction of the extension of the handle.

A playing piece sits on a disk 16 with shoulder 16*a* fitting within channel 24*a*. During play, a disk 16 may be turned in its recess 12*e* with turning assisted by gripping with the fingers shoulder 16*a*. Thus, the shoulder constitutes manipulation-assisting means for promoting leveraged rotation of a disk. With a playing piece seated on a disk, the disk may be turned utilizing handle 24*b* in the playing piece.

Figure 3:
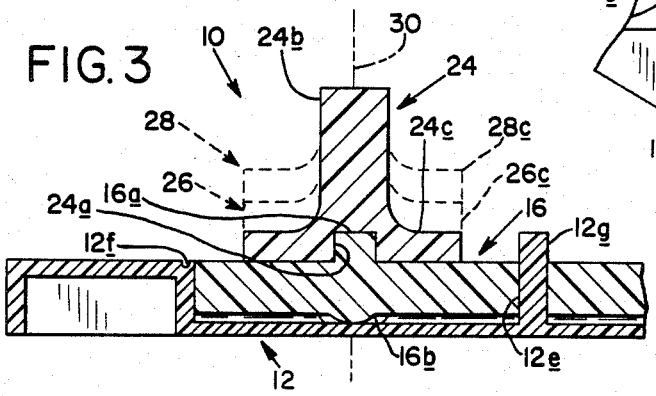
FIG. 3 is a further enlarged, cross-sectional view, taken along line 3—3 in FIG. 2.

As illustrated in FIG. 1, a cluster of nine playing pieces are shown seated or superimposed on the disks adjacent the base of the playing board. Another cluster of nine playing pieces are seated on the disks adjacent the top of the board. These playing pieces in the various clusters have been given the reference numerals 24, and, in addition, reference numerals 26 and 29. Playing pieces 26 are visually distinctive from playing pieces 24, and this may be accomplished by making the bases of these playing pieces somewhat thicker, as perhaps best illustrated in FIG. 3 by the outline of the playing piece shown in dashed outline at 26 in FIG. 3. Similarly, playing piece 28 is visually distinctive from playing pieces 24, 26, and this result can be achieved by making the base of playing piece 28 even thicker than the base of playing pieces 24, 26. This relationship is illustrated in FIG. 3 by the outline of the playing piece indicated in dashed outline at 28. In other respects, the various playing pieces are essentially the same.

Preferably, the base of a playing piece is not so large as completely to cover the disk which underlies it. In this way, the orientation of a path segment or ridge 16*a* is visually apparent even when a playing piece is mounted on top of a disk.

Further describing game apparatus 10, a narrow groove 12*f* extends in a hexagonal course around each recess 12*e* that receives a disk. The groove provides visual delineation between the disks. The straight expanses of a groove extend perpendicular to row directions on the board along which paths may be formed.

To further aid in the visualization of rows as they are developed during play, bosses or knobs 12*g* having generally box-like shapes and conforming in cross-sectional size with shoulders 16*a* are provided on the game board between the ends of straight expanses of grooves 12*f*. When adjacent disks are positioned so that their shoulders or path segments 16*a* are in alignment, the shoulders together with a knob 12*g* lying between the adjacent ends of the shoulders cooperate to produce what appears to be a continuous path.

Considering now how a game may be played on the apparatus illustrated, FIG. 1 illustrates the apparatus as it may be set up when play is initiated. As earlier discussed, nine playing pieces (which one player utilizes) are clustered adjacent one extremity of the board with these seating on underlying disks. Another nine playing pieces are clustered adjacent the opposite extremity of the board which the opposing player utilizes. Each set includes five playing pieces with thin bases, referred to herein as thin playing pieces, three playing pieces with somewhat thicker bases, referred to herein as intermediate playing pieces, and a single playing piece with an even thicker base, referred to herein as a thick playing piece. A thin playing piece may be allowed two moves during one turn of a player, and intermediate playing piece may be allowed three moves, and a thick playing piece may be allowed five moves.

For ease of explanation, the lower set of playing pieces in FIG. 1 used by one player have been designated "A", while the playing pieces of the opposing player have been designated "B". Following the letter designation appears a number, which refers to the number of moves permitted the playing piece during a turn. In the case of the thin and intermediate playing pieces, where there are more than one of the particular type of playing piece provided a player in a set, there then appears a diagonal line followed by a number, which represents the number of the playing piece in the particular set. Thus, "A2/1" indicates that the playing piece is for player A, that the playing piece is permitted two moves during a turn, and that the particular playing piece is number 1 of the five playing pieces of this type provided the player.

As used herein, the term "move" relates to activity on the board, and may include either manipulation of a disk to reposition it, or capturing of an opponent. When a playing piece is disposed on a continuous path formed of aligned path segments, and such path includes the disk on which the playing piece is located, movement of that playing piece along this path does not constitute a move.

At the start of play, the thick playing piece provided a player is mounted on a disk 16 which is located in a corner of board 12. The three immediately adjacent disks which surround this corner disk support the three intermediate playing pieces given to a player. Supported on the disks surrounding the disks on which the intermediate playing pieces are located are the five thin playing pieces.

Additional rules not mentioned above are now presented. The object of play is to remove all of the opponent's playing pieces before one's own playing pieces are completely removed. The removal or capture of an opponent's playing piece is achieved by moving one's own playing piece along a continuous path formed of aligned path segments, including the path segment on the disk on which one's capturing playing piece is disposed as well as the path segment on the disk on which the to-be-captured playing piece is disposed. Capture is effected by setting one's own playing piece on the disk on which the to-be-captured playing piece was disposed after removing the captured playing piece from that disk. As discussed previously, this constitutes a move during one's turn.

A playing piece may capture a playing piece of an opponent of any other rank. Thus, a thin playing piece may capture a thick playing piece of the opponent. A playing piece may move along any continuous path lined up with the path segment on which the playing piece is disposed, so long as there is not an opposing playing piece on the path. The only way to travel past such a playing piece would be to capture it first and then move on.

A playing piece of one player may freely pass over any other playing pieces of that same player which are disposed along the same path.

Only those disks may be moved during a turn which are either adjacent a player's playing piece or are moved to extend a continuous path on which a designated playing piece is positioned.

Discussing now actual play and a set of turns which illustrate the various rules just described, one player must be designated as the initiating player in order to begin the game, such as by flipping a coin.

Figure 5:
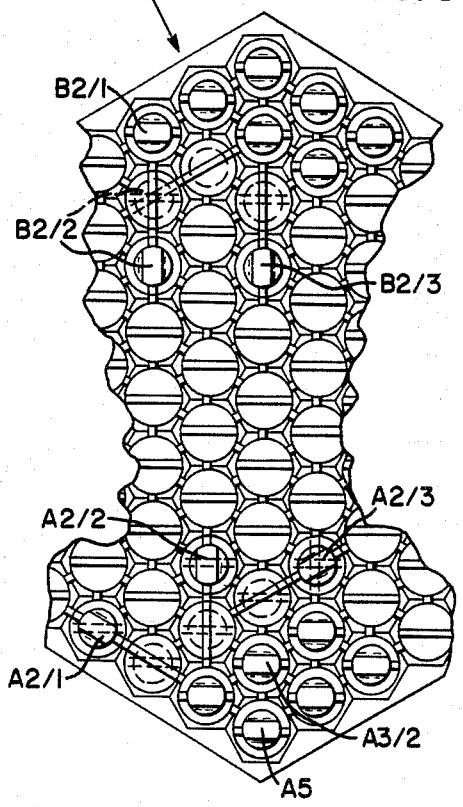
FIGS. 5–8 illustrate on a reduced scale the game board of FIG. 1, showing a progression of moves of playing pieces in a representative game.

FIG. 5 illustrates three sequential moves by each player which have occurred from the starting positions illustrated in FIG. 1. Assuming player "A" won the flip of a coin, her first choice was to move playing piece A2/1 upward and to the left from its initial position. In order to accomplish this she rotated the disk on which piece A2/1 was disposed to reorient the path segment of the disk so that it extended upwardly and to the left as shown in FIG. 5. The dashed circle on that playing piece's original disk shows where that playing piece was positioned at the beginning of the turn. The adjacent disk was similarly rotated. The manipulation of the two disks whereby a path was formed by the two associated path segments of the disks constituted the two moves permitted for that turn. A2/1 was then moved onto the new disk, which action did not constitute a "move".

Following player "A"'s first move, player "B" then chose to move player B2/2 downwardly and to the left one disk, by rotating the disk it was originally on, rotating the disk he intended to move it onto, and then actually moving the playing piece onto the reoriented adjacent disk. This new position is shown in FIG. 5 by a dashed reference line, to illustrate that although that playing piece is not in that position at the end of the three-turn sequence shown by FIG. 5, it occupied that position at the end of player "B"'s first turn.

Using similar moves on board 12 of disks 16, player "A" then moved playing piece A2/2 straight upward toward player "B"'s playing pieces. Player "B" then moved playing piece B2/2 from its new position straight down below playing piece B2/1. Again a rotation of two adjacent disks was required in order to accomplish this move.

Player "A" then moved playing piece A2/3 upwardly and to the right as shown. At this time, player "A" had moved a thin playing piece in each of the three row directions, permitted by the board. Player "B" followed by moving playing piece B2/3 downwardly one disk. The two moves of playing piece B2/2 illustrate that a path formed of aligned path segments may be broken up, followed by a realignment, to form a new path.

Figure 6:
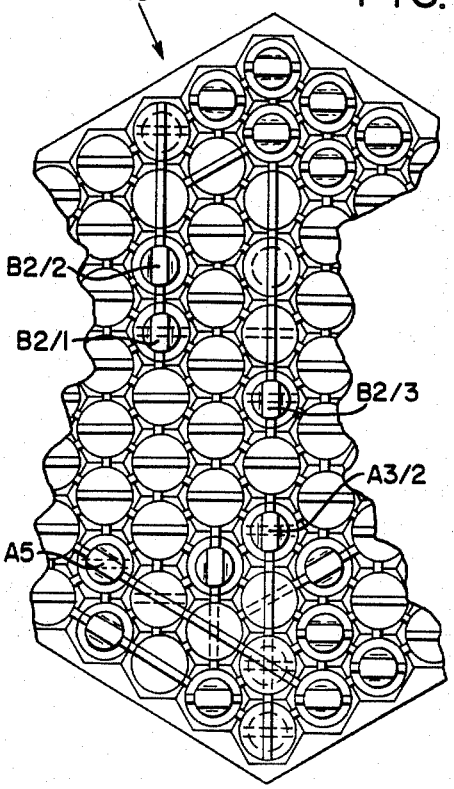

Referring now to FIG. 6, player "A" next moved playing piece A3/2 directly upward two disks. In order to accomplish this, it was necessary to rotate the disk that playing piece A3/2 was originally located on, as well as the two disks directly above that disk. This permitted placement of playing piece A3/2 in the position shown in FIG. 6. The three moves are permitted, since playing piece A3/2 is an intermediate disk. It can be seen at the completion of this move that there are three rather than two path segments formed into a path.

Player "B" then responded to player "A"'s turn by moving playing piece B2/1 to the disk just below playing piece B2/2. It was possible to make a move to a disk three disks from its original position since two of those disks were already in alignment due to prior movement of playing piece B2/2 in the same direction. Therefore, it was only necessary to rotate the disk the playing piece originally started on and the disk the piece ended up on. As will be recalled, a playing piece may jump over any playing piece of the same set and that such a movement is not a "move" under the rules of the game.

Player "A" then chose to move her thick playing piece A5 to the disk disposed above the location of playing piece A2/1 after three turns of play. The five moves which player "A" made in order to accomplish this are as follows. The disk on which playing piece A5 originally was placed was moved to align its path segment vertically with the path segment just above it. This took only one move. In four successful moves, the disk now supporting piece A5 was moved to orient its path segment upwardly and to the left, and this was followed with similar reorientation of the three disks lying in the row extending upwardly and to the left of the disk.

Still referring to FIG. 6, "B"'s final move, as illustrated in the figure, was to move playing piece B2/3 down from the position occupied in FIG. 5 two more disks, to the position shown in FIG. 6. This position is two disks above playing piece A3/2.

Figure 7:
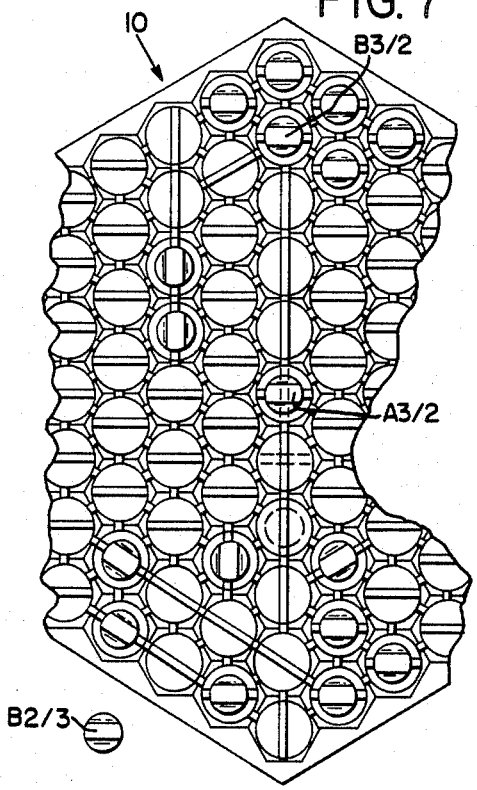

Only one move, albeit a critical one, is illustrated in FIG. 7. This figure illustrates the move by player "A" following the last described move by player "B". The reader will recall that movement of playing piece A3/2 may be accompanied by three moves during a turn. Thus, by aligning the disk directly above it, playing pieces A3/2 and B2/3 are placed on a common continuous path. The second move associated with this turn is used to capture playing piece B2/3 by playing piece A3/2. Thus, FIG. 7 shows the final position of playing piece A3/2 on the disk where playing piece B2/3 was previously located. Playing piece B2/3 has been removed from board 12, and therefore from play, and located off the board adjacent player "A"'s playing position. At this point, player "A" has an advantage over player "B" in that she has one playing piece more than does player "B".

As just stated, player "A" only had to make one disk-alignment move in order to put playing piece A3/2 on the same path as playing piece B2/3. The second move was used to capture playing piece B2/3. This left one move remaining for playing piece A3/2. This move was used to misalign the disk on which playing piece A3/2 was finally disposed relative to the path it was on. As is shown in FIG. 7, the disk on which playing piece A3/2 is finally located has been turned into the original sideways orientation that existed at the start of play.

Figure 8:
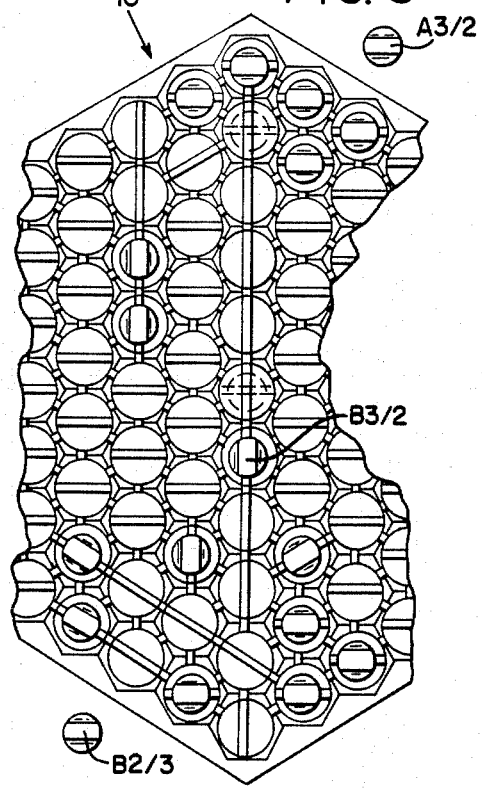

Reference to FIG. 8 will show that the advantage player "A" was able to achieve by removing playing piece B2/3 was short-lived. It will be seen, by studying FIG. 8, that player "B" was able to capture playing piece A3/2 by moving playing piece B3/2 down to it. In order to do so it was only necessary to establish a path on which both the capturing and the captured playing pieces were located, by reorientating the two disks supporting these playing pieces. This permits piece B3/2 to capture playing piece A3/2 in three moves.

It will be noted, however, that playing piece B3/2 did not end up on the disk where playing piece A3/2 was captured. The reader will recall that movement of a playing piece along a path does not constitute a "move". Thus, to complete the turn associated with movement of playing piece B3/2, player "B" had the option of moving that playing piece anywhere along the path which existed at the end of the turn. Player "B" chose to move playing piece B3/2 one disk below that disk where capture of playing piece A3/2 occurred.

Although the foregoing sequence of moves within given turns does not complete the playing of a game, sufficient play has been illustrated to show the various types of moves which are allowed by the rules of the game. Movement of all three types of playing pieces has also been illustrated. Play of the nature described continues until one player has eliminated all of an opponent's playing pieces while retaining one or more of his or her own on the playing board.

While the invention has been particularly shown and described with reference to the foregoing preferred embodiment, it will be understood by those skilled in the art that other changes in form and detail may be made therein without departing from the spirit and scope of the invention. As an example, it is possible that a game as contemplated by this invention may be formulated using orthogonally oriented intersecting rows, and that other array and board shapes may be used. Other mechanical arrangements may be provided for supporting the disks and mounting the playing pieces. Further, the game could be reduced to two dimensional images on a video screen for play using computerized controls to manipulate the elements and playing pieces as has been described for the playing board.

It is claimed and desired to secure by Letters Patent:

1. Game apparatus comprising:

means defining a playing field, a substantially planar array of elements rotatably mounted on said playing field for rotation about axes substantially normal to the plane of the array, said elements forming at least two intersecting rows extending in said plane, a surface feature defining a path segment extending across the face of each element, the elements being rotatable to produce alignment of path segments in said elements in either one or the other of said rows, and playing pieces superimposable on said elements and moveable over said elements along aligned path segments.

2. Game apparatus comprising a board, a substantially planar array of elements rotatably mounted on said board for rotation about axes substantially normal to the plane of the array, said elements forming at least two intersecting rows extending in said plane, a surface feature defining a path segment extending across the face of each element, the elements being rotatable to produce alignment of path segments in said elements in either one or the other of said rows, and playing pieces supportable on said elements and moveable over said elements along aligned path segments.

3. The apparatus of claim 2, wherein said board has cylindrical recesses, and wherein said elements are rotatably mounted in said recesses.

4. The apparatus of claim 3 which further includes indent/detent means interposed between said elements and said board promoting positioning of the elements in positions where path segments are aligned.

5. The apparatus of claim 2, wherein said elements form three rows intersecting at a point within an element, and the elements are rotatable to produce alignment of path segments in said elements in either of said three rows, said rows being equiangularly offset.

6. The apparatus of claim 5, wherein said board includes means delineating a hexagon extending about each element, and the sides of a hexagon extends perpendicular to the rows which the elements form.

7. The apparatus of claim 2, wherein a surface feature provides manipulation-assisting means formed on the face of an element promoting mechanical leveraging of rotation.

8. The apparatus of claim 7, wherein a surface feature is a ridge formed on the element.

9. The apparatus of claim 8, wherein a playing piece includes a channel formed on the base thereof constructed to fit over said ridge.

10. Game apparatus comprising a generally planar board, a generally planar array of path-segment-defining disks rotatably mounted on said board for rotation about axes normal to the plane of the board, said disks being disposed in rows and located in such a manner that each disk exists at the intersection of three equiangularly offset rows, each disk having a surface feature defining a linear path segment, adjacent disks being rotatable to produce selectively alignment of path segments in said disks along said rows, and playing pieces supported on said disks and moveable over said disks along aligned path segments.

* * * * *